United States Patent [19]

Löffler

[11] Patent Number: 5,010,820

[45] Date of Patent: Apr. 30, 1991

[54] PROCESS FOR THE DEFINED PRODUCTION OF AN INK DISTRIBUTION APPROPRIATE TO A PRODUCTION RUN IN THE INKING UNIT OF ROTARY PRINTING PRESSES

[75] Inventor: Gerhard Löffler, Walldorf, Fed. Rep. of Germany

[73] Assignee: Heidelberger Druckmaschinen AG, Heidelberg, Fed. Rep. of Germany

[21] Appl. No.: 482,260

[22] Filed: Feb. 20, 1990

Related U.S. Application Data

[63] Continuation of Ser. No. 166,556, Mar. 10, 1988, abandoned.

[30] Foreign Application Priority Data

Mar. 11, 1987 [DE] Fed. Rep. of Germany ..... 3707695

[51] Int. Cl.[5] ..... B41F 31/04; B41F 31/20; B41M 27/08

[52] U.S. Cl. ..... 101/484; 101/350; 101/365; 101/DIG. 32

[58] Field of Search ..... 101/DIG. 45, DIG. 47, 101/365, 350, 148, 363, 349, 484, 425, DIG. 32, 207–210, 483; 356/380; 250/559; 358/107; 364/526

[56] References Cited

U.S. PATENT DOCUMENTS 3,771,446 11/1973 Kaneko et al. ..... 101/144
3,965,819 6/1976 Punater ..... 101/350
4,655,135 4/1987 Brovman ..... 101/365
4,660,470 4/1987 Kramp et al. ..... 101/426
4,782,756 11/1988 Howard ..... 101/425

FOREIGN PATENT DOCUMENTS 2073665 10/1981 United Kingdom .
2080201 2/1982 United Kingdom .

*Primary Examiner*—J. Reed Fisher
*Attorney, Agent, or Firm*—Nils H. Ljungman & Associates

[57] ABSTRACT

In the inking unit of a rotary printing press stand, a specified zonal adjustment for each print job is made to the ink ducts, which corresponds to the ink consumption required for the printed product in question. To create an ink distribution in the inking unit appropriate to the print run during the conversion of the inking unit from a previous job to a subsequent and new print job, the invention provides an improved method for the removal of the current ink profile so that the new ink profile can be established for the subsequent print job in a short time, without the necessity of emptying, cleaning and washing the inking unit. To change the ink profile before the beginning of printing, two process steps are proposed. First, the ink profile in the inking unit from the previous job is removed while the machine is running, and thereafter the ink profile in the inking unit appropriate to the subsequent print job is established under precisely defined conditions. Alternatively, a direct transition is made between the previous and subsequent required ink profiles.

19 Claims, 8 Drawing Sheets

EXAMPLE OF A THEORETICAL PROGRAM SEQUENCE FOR THE DETERMINATION OF THE NECESSARY INK STRIP LENGTH $bi^*$, THE INK ZONE SETTINGS $Si^*$ AND THE REQUIRED NUMBER OF PRESS ROTATIONS $Zn5i$ FOR THE REMOVAL OF THE INK PROFILE OF THE LAST JOB AND THE SIMULTANEOUS BUILD UP OF THE INK PROFILE FOR THE NEXT JOB, AS WELL AS ANY REQUIRED EQUILIBRIUM INK ZONE SETTINGS $Si^{**}$ AND THE CORRESPONDING NUMBER OF MACHINE REVOLUTIONS $\Delta Zn5i$, WITHOUT TRANSPORT OF INK.

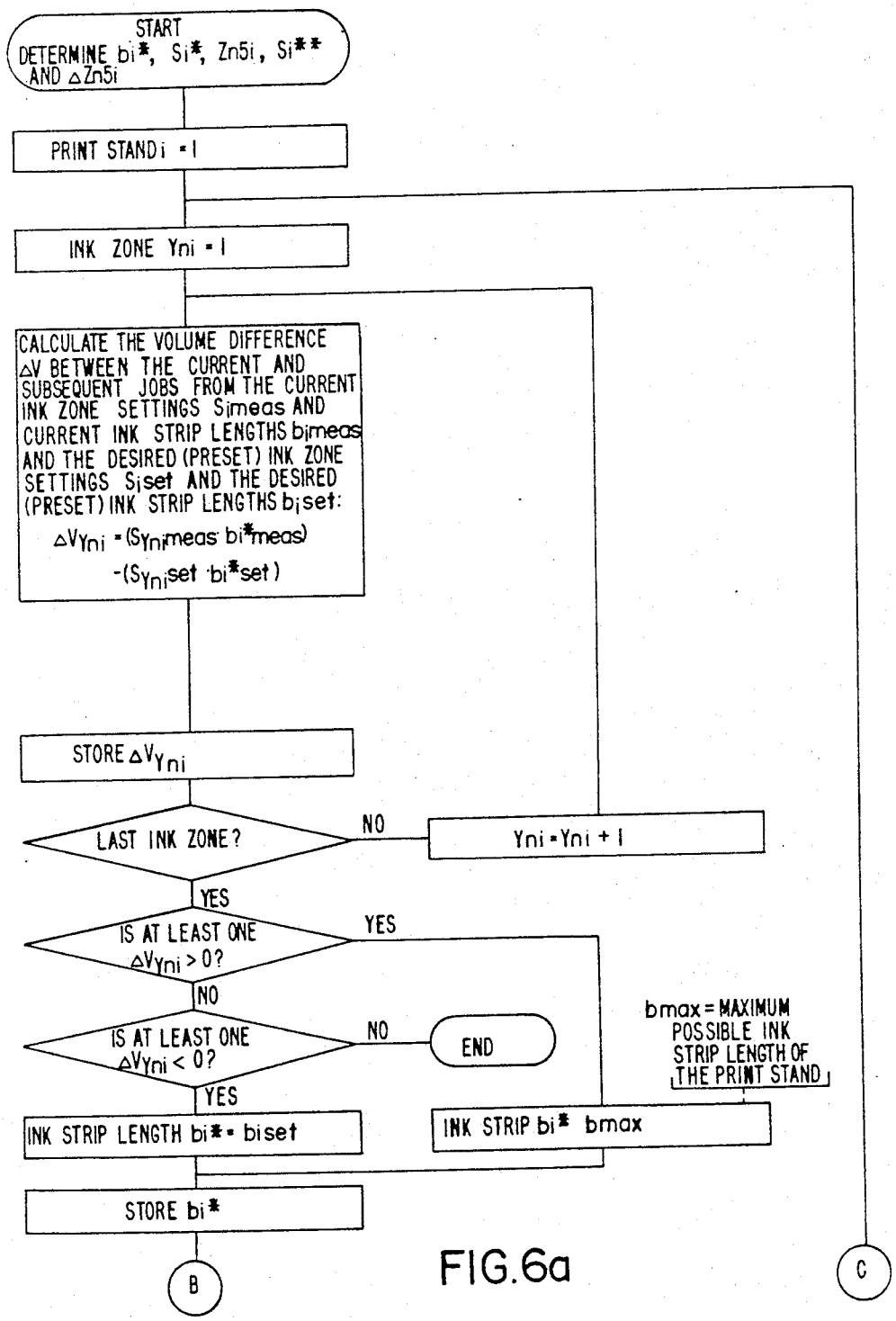

FIG.6a

PROCESS FOR THE DEFINED PRODUCTION OF AN INK DISTRIBUTION APPROPRIATE TO A PRODUCTION RUN IN THE INKING UNIT OF ROTARY PRINTING PRESSES

This is a continuation of application Ser. No. 07/166,556, filed on Mar. 10, 1988, now abandoned.

BACKGROUND OF THE INVENTION

1. Field of the Invention

On rotary printing presses, particularly on offset rotary printing presses, it is necessary to feed a very thin and uniform ink film to a printing plate wetted by a wetting agent. For the high-viscosity printing inks normally used currently, a complex inking unit equipped with many rollers is generally required to produce this thin and uniform ink film. A result of the high viscosity of the inks currently used and the many rollers employed in the inking unit is that it takes longer to achieve an appropriate ink distribution in the inking unit to ready it for printing.

2. Description of the Prior Art

U.S. Pat. No. 4,660,470, entitled "Inking Unit Pre-Adjustment Method" and issued Apr. 28, 1987, which corresponds to German Laid Open Patent Appln. No. DE-OS 33 38 143, describes a process for presetting the inking unit, wherein the process starts with an empty, washed inking unit. The objective is to produce a defined basic ink layer 4 to 5 microns thick on all the rollers, so that the desired ink profile can be applied to them in a second process step. The second step is thereby either performed when printing has started, or else the printing is delayed until after the definitive achievement of the desired ink profile and ink gradient.

In practice, when there is a job change, the new printing job is set up and run without washing the inking unit. Additionally, in many cases, the inking unit is not washed before long periods of inactivity, e.g., before weekends or holidays. Such practices are made possible by so-called "overnight inks". In actual practice, therefore, regardless of the quantity of ink and the ink distribution of the previous job, the machine is positioned to the new setting, and the zonally existing excess quantities of ink are removed from the inking unit by the printing of a large number of waste sheets, if the new job requires zonally less ink than the previous job.

As noted above, U.S. Pat. No. 4,660,470 (issued Apr. 28, 1987) described as process for establishing a desired ink zone profile in a rotary printing press. This U.S. patent hereby expressly incorporated herein by reference, as if the contents thereof were fully set forth herein.

The published technical papers "Possibilities and Margins of the Computerized Analysis of Offset Inking Units (I)", Prof. Dr.—Ing. Helmut Rech, druck print 8/1984, pp. 522-523; "Possibilities and Margins of the Computerized Analysis of Offset Inking Units (II)", Prof. Dr.—Ing. Helmut Rech, druck print 9/1984, pp. 578-582; "Possibilities and Margins of the Computerized Analysis of Offset Inking Units (III)", Prof. Dr.—Ing. Helmut Rech, druck print 10/1984, pp. 659-660; "Possibilities and Margins of the Computerized Analysis of Offset Inking Units (IV)", Prof. Dr.—Ing. Helmut Rech, druck print 11/1984, pp. 725-726; and "Rechnergestützte Entwicklung von Farbwerken in Druckmaschinen", Prof. Dr.—Ing. Helmut Rech, Der Polygraph 9, 1981, pp. 699-709 discuss the use of computer assisted iterative simulations, modelings, and empirical or semi-empirical methods for establishing ink transfer characteristics and parameters in rotary printing presses.

Issued U.S. Pat. No. 4,441,819 (issued Apr. 18, 1984) and issued U.S. Pat. No. 3,958,509 (issued May 25, 1976), issued European Patent No. 0 081 739, published European Patent Appln. No. 0 095 606 and the prior published technical documents "Flow of Information in the System", "Description of Commands, Store", "Description of Commands, Zones Identical-Gradual Adjustment", "Description of Commands, Cassette: Read In", and "Heidelberg CPC" (Publication No. HN 2/43.e), all of which have been previously published by Heidelberger Druckmaschinen AG, D-6900 Heidelberg, Federal Republic of Germany, discuss the use of a control stand computer to control the printing process and methods by which appropriate ink zone settings and appropriate ink strip lengths may be chosen, preset into the control stand computer, and/or adjusted during the printing process. The above mentioned U.S. Pat. Nos. 4,441,819 and 3,958,509 are additionally expressly incorporated by reference herein.

OBJECTS OF THE INVENTION

A principal object of the present invention is, therefore, the provision of a process for the production of a defined ink distribution (or new ink profile) in the inking unit appropriate to a new (or subsequent) printing run, in which the new profile is achieved without the need to completely empty and wash the inking unit.

This object may be achieved by adoption of the embodiments set forth below.

SUMMARY OF THE INVENTION

In a first embodiment, the modification of the ink profile takes place before the printing of the subsequent run and includes two steps. First, the ink profile present in the inking unit from the previous printing job is removed (or leveled to a uniform thickness) while the machine is still rotating by: initially, closing the ink dosing (or metering) elements, and transporting the quantities of ink present zonally in the inking unit, as a function of the profile, back into the ink duct by means of a specified number of rotations (which may, according to the invention, be determined by simulative, empirical or semi-empirical methods well known in the art), until a uniformly small and defined thickness of ink, independent of the profile (e.g., a base ink layer), is present on all the rollers. Thereafter, the ink profile required for the subsequent printing job is established in the inking unit by a zonal adjustment of the ink metering elements by adjusting the length of the ink strip which is transferred into the inking unit (hereinafter referred to as the "ink strip length" or, more colloquially, as used by artisans in the printing field, the "ink strip width"), and by means of a defined number of rotations of the inking unit (determined via simulative, empirical or semi-empirical methods), so that an appropriate profile can be established under precisely defined conditions.

A primary advantage of the present invention is that a precisely defined base ink layer can be produced on all rollers directly from the ink profile remaining after the preceding job, starting from any given profile, and that the subsequent establishment of a new profile is accomplished automatically, that is, with very little intervention or judgement required on the part of the printing press operator. The printing press operator is thereby able to set up a new printing job in the shortest possible time and without major effort or expense, eliminating the use of a large number of waste sheets and the major time and expenditures involved in cleaning the inking unit. The ink strip to be transferred into the inking unit by means of a vibrator inking unit, for example, can be the length of the ink strip transferred by the vibrator roller.

An inking unit with a uniformly low and defined ink thickness on all the rollers independent of the profile is achieved by setting the vibrator roller for a specified number of machine rotations with closed ink dosing elements, preferably with a setting to invoke the maximum ink strip length, and according to the ink separation characteristics of the particular ink employed, that ink is transported back into the ink duct (or ink reservoir). Since the zonal ink profile gradually disappears, the closer it gets to the inking rollers, during the return of the ink, in addition to the removal of the ink gradient, the zonal profile is also eliminated. The next process step can either take place immediately afterward, or be delayed in relation to the first. That is, some time interval may be imposed between the achievement of a uniform ink profile in the inking mechanism due to the removal of ink from the inking mechanism and the subsequent process step of setting up a new ink profile appropriate to the subsequent printing job. In the determination of the required number of rotations of the inking unit, as described below, the required ink gradient in the inking unit is taken into consideration, so that the printer operator need only start the job change, and in the shortest possible time, and without manual intervention, he can start to print the new job.

The process according to another embodiment, as a function of the quantitative zonal ink balance between the previous printing job and the subsequent printing job, makes it possible to produce the new ink profile in the ink unit directly, ready for the print run, without the production of an intermediate uniform base ink layer. For this purpose, before beginning to print, first the values stored in the computer for the zonal adjustment of the dosing elements and the length of the ink strip used for the previous print job are compared with the values input into a computer memory for the zonal adjustment of the ink dosing elements and the length of the ink strip used for the subsequent print job, and the zonal differences are determined from the ink zone values. These values, supplemented by the zonal quantities stored by the inking unit, are transported from the rotating inking unit back into the ink reservoir, depending on whether the difference in the quantity of ink is positive or negative. The number of inking unit rotations required for the purpose until the zonal differences are equalized is initially determined first, and only then are the ink dosing elements adjusted and the length of the ink strip transferred into the inking unit for the subsequent printing job. During this adjustment, before the beginning of the print run, no ink is transported out of or into the inking unit when printing has been stopped.

The process steps take place automatically, so that here too, an ink distribution in the inking unit can be achieved which is appropriate to the printing run.

To obtain the correct ink gradient in the inking unit, this process also makes it possible to withdraw somewhat more ink than strictly necessary during the first part of the activation of the inking unit, and during the remainder, to add the same amount of ink back again. The correct ink gradient is thereby adjusted automatically, which fact can be taken into consideration in the determination of the number of rotations or zonal adjustments.

In zones with a satisfactory balance, no change is made. For example, ink can be extracted during the first half of the number of machine rotations to be executed, and the same amount of ink can be added back again in the second half. The correct ink gradient is thereby adjusted automatically, which fact can be taken into consideration in the determination of the number of rotations or zonal adjustments.

The determination of the required number of machine rotations can be based, for example, on a maximum ink strip length, the closing of the zones with positive ink differences and the opening of the zones with negative ink differences to the new position. Naturally, other combinations are also possible, e.g., the determination of an ink strip length which results in the same number of machine rotations for the zones with positive quantitative ink differences as for the zones with negative quantitative ink differences.

The ink profile corresponding to the new printing job and the corresponding ink strip length can be determined, for example, by gauging the printed proof or the printing plate, and inputting the result via a data line or a data medium, or it can be manually input and stored by the printer.

For the characteristics described above, it is to be assumed that the zonal ink differences are used for the calculation of the ink strip length and the zonal adjustments required. Also taken into consideration is the fact that the ink roller unit stores a zonal quantity of ink which is a function of the zonal ink consumption, which is greater than the quantitative ink differences between the two printing jobs. For example, it is possible, in the computation of the ink strip length, to determine an average value of the ink quantities stored in the inking unit between zones with positive and negative differences.

There may also be provided advantageous process steps to remove the current ink profile, whereby the ink dosing elements are moved into closed positions, the ink duct rollers are preferably set to maximum ink strip length, the vibrating roller movement is initiated, a defined number of inking unit rotations are executed, the vibrating roller movement is stopped, and the inking unit continues to rotate a defined number of rotations until the end of the ink profile removal.

During this process, the establishment of the ink profile required for the subsequent print job is accomplished by individual process steps, whereby the ink metering elements are adjusted by zones to the required ink profile, the ink duct rollers are set to the determined ink strip length, the vibrator roller motion is initiated, a defined number of inking unit rotations are executed, and the paper flow and printing begin, or the vibrator roller motion is stopped, or the vibrator roller motion is stopped and the machine is stopped.

The present invention also provides for an accelerated removal of the current ink profile, while the paper flow continues, by means of the following process steps: with simultaneous paper flow, the ink duct rollers are preferably set to maximum ink strip length; the vibrator roller motion is initiated; the paper flow and printing are initiated: a defined number of machine rotations are executed; the vibrator roller movement is stopped; at the end of the ink profile removal, the machine continues to rotate for a determined number of rotations without paper flow; and thereafter the profile is established as described above.

There is also provided an alternative embodiment, wherein the paper flow continues, but without the return of ink to the ink duct, and wherein an accelerated removal of the current ink profile is accomplished by means of the following process steps; the paper flow and printing are started: a defined number of machine rotations are executed; the paper flow and printing are stopped; at the end of the ink profile removal the machine continues to rotate for a determined number of rotations without paper flow; and thereafter the profile is established as described above.

The invention also provides a second embodiment for the execution of an automatic sequence of operation, in which a removal of the current ink profile and a simultaneous establishment of the ink profile required for the subsequent print job are carried out simultaneously by means of the following individual process steps: the ink dosing elements are zonally adjusted according to the differential ink quantities determined; the ink duct rollers are set to a calculated ink strip length: vibrator roller movement is initiated: the mathematically determined number of inking unit rotations for the simultaneous removal of the old profile and establishment of the new profile are executed; the ink metering elements for the subsequent print job are zonally adjusted to the required ink profile: the ink duct rollers are set to the required ink strip length; and the paper flow and printing are initiated; or, alternatively, the vibrator roller movement is stopped and the machine is shut down.

In general, the invention features a controlled process for changing an ink zone profile in at least one printing stand from a previous ink zone profile corresponding to a previous printing job to a subsequent ink zone profile corresponding to a subsequent printing job, the printing press comprising a printing plate cylinder for positioning a printing plate, an ink reservoir for holding a supply of ink and an inking mechanism for transferring the ink between the ink reservoir and the printing plate during operation of the printing stand, the inking mechanism comprising a plurality of inking rollers and a plurality of individually adjustable ink zone metering devices for transferring the ink between the ink reservoir and at least one of the plurality of inking rollers, the process comprising the steps of: (a) calculating at least one previous parameter characterizing the previous ink zone profile; (b) calculating at least one subsequent parameter characterizing the subsequent ink zone profile; and (c) adjusting at least one of the plurality of adjustable ink zone metering devices, in accordance with the calculated previous and the subsequent parameters, and operating the inking mechanism to thereby change the ink zone profile in the printing stand from the previous ink profile to the subsequent ink profile.

In one aspect, the process includes the steps of (A) beginning with the previous ink zone profile; (B) transferring ink from the inking mechanism, through at least one of the plurality of ink zone metering devices and into the ink reservoir so as to establish, on the plurality of inking rollers, a base ink layer, the base ink layer being substantially uniform in thickness across the ink zones; and (C) thereafter, transferring ink from the ink reservoir, through at least one of the plurality of ink zone metering devices and into the inking mechanism so as to establish the subsequent ink zone profile.

In another aspect, the process includes the steps of (A1) beginning with the previous ink zone profile; (B2) determining, for each of the plurality of ink zones, a volumetric difference indicator indicative of the change of ink volume between the ink volume remaining in the inking mechanism from the previous printing job and the ink volume required in the inking mechanism for the subsequent printing job; (C2) adjusting each of the plurality of ink metering devices in accordance with the corresponding ink zone volumetric difference indicator determined in step (B2): and (D2) actuating the inking mechanism until the subsequent ink zone profile is substantially achieved therein.

The invention will now be described by way of particular preferred embodiments, reference being had to the accompanying drawings, wherein:

BRIEF DESCRIPTION OF THE DRAWINGS

FIGS. 6*a*, 6*b* and 6*c* constitute a flow chart of a subprocess for determining certain parameters for the implementation of a process conducted according to FIG. 5.

DETAILED DESCRIPTION OF THE PREFERRED EMBODIMENTS

Figure 1:
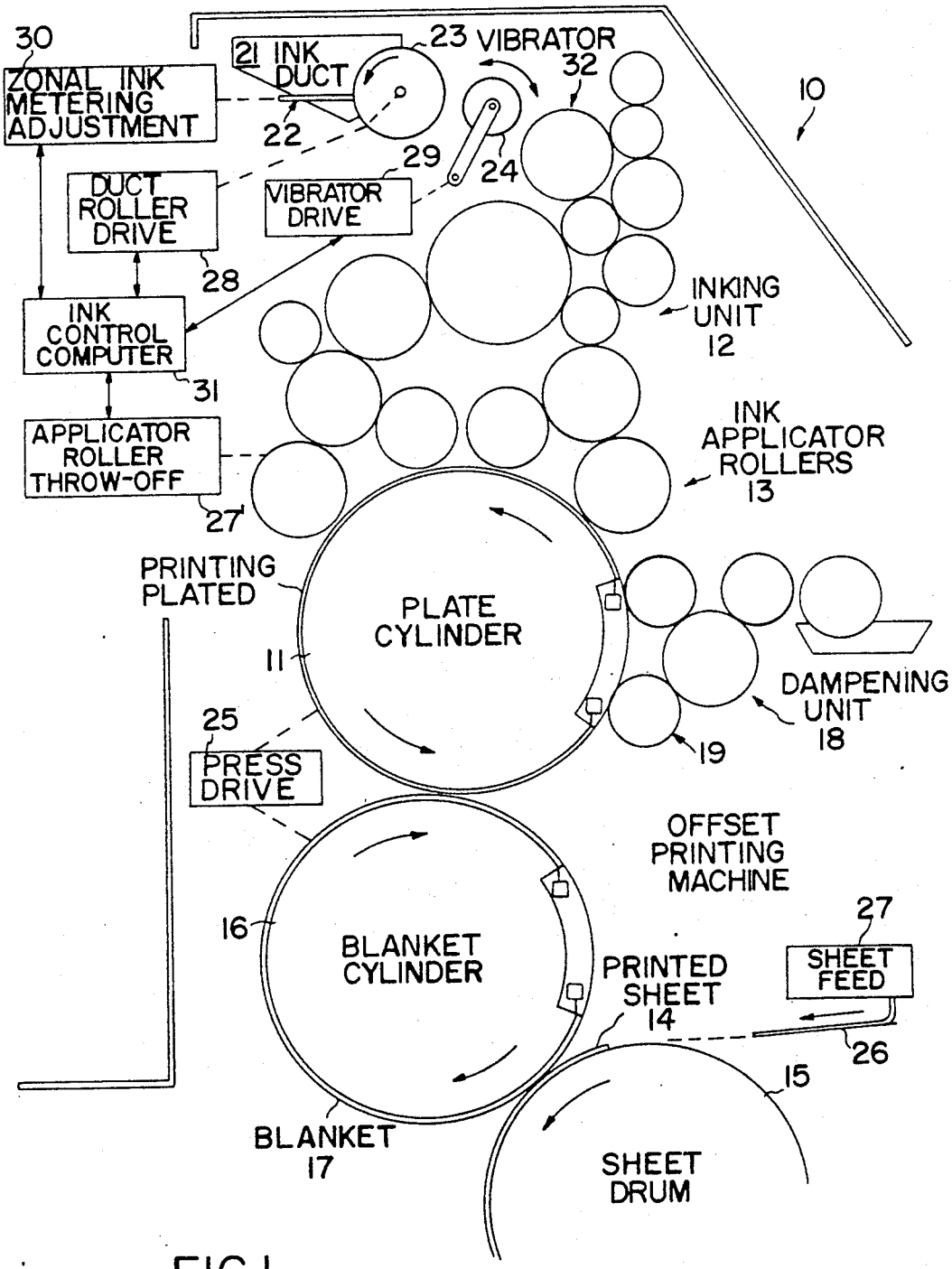
FIG.1 PRIOR ART
FIG. 1 is a schematic representation of one printing stand of a rotary offset printing press known in the art and in cooperation with which the present invention provides an improved process for the adjustment of the inking mechanism thereof.

Referring first to FIG. 1, a rotary print stand 10, well known in the art, generally includes: a plate cylinder 11 having mounted thereon a printing plate D; an inking unit 12 which includes ink applicator rollers 13 for applying to printing plate D an ink profile of a single color printing ink (for example, black, cyan, magenta or yellow): a dampening (or wetting) unit 18 having dampening applicator rollers 19 for transferring a dampening agent to printing plate D; a blanket cylinder 16 carrying a rubber blanket 17 for receiving an ink impression from printing plate D; and a sheet drum 15 for carrying a printed sheet 14 onto which the ink impression carried by blanket 17 is transferred.

It is particularly important that the ink be applied to printing plate D in a precisely defined and controllable manner. That is, those areas of printing plate D having a high density of printed content will require a greater ink flow during the printing process than those areas having a lower density of printed content. To this end, the printing stand 10 is typically provided with a means for zonally varying the ink application profile across the width of the printing stand 10. For example, as shown in FIG. 1, printing stand 10 may be provided with an ink duct 21 which extends across its width. The zonal adjustment of the ink application profile is provided by a plurality of ink metering ducts 22 which may be controlled or adjusted by a zonal ink metering adjustment mechanism 30 under the control of a computer 31.

A duct roller 23 is typically mounted adjacent to ink duct 21. An ink duct of this type is further described in U.S. Pat. No. 3,978,788, issued Sept. 7, 1976, the contents of which are hereby expressly incorporated by reference as if this patent were set forth in its entirety herein.

Typically, the ink application profile which is set up on duct roller 23 is transferred into the inking unit 12 by means of a vibrator roller 24 which oscillates to successively pick up strips of ink from duct roller 23 and transfer them into inking unit 12, as for example, by contacting one of the rollers 32 thereof. The operation of such a vibrator roller 24 is more fully described in U.S. Pat. No. 3,908,545, issued Sept. 30, 1975, this issued U.S. patent being hereby expressly incorporated by reference as if the contents thereof were set forth fully herein.

Typically, the printing stand 10 will also include auxiliary mechanisms such as, for example, a duct roller drive 28, a vibrator roller drive 29, an applicator roller throw-off 27' for lifting the ink applicator rollers 13 off of the printing plate D, a press drive 25 and a sheet feed 27 for supplying the sheets to be printed 26 to sheet drive drum 15.

U.S. Pat. No. 4,660,470, which has been incorporated herein by reference, describes the difficulties encountered in achieving a desired ink profile equilibrium for a particular printing job. For example, that patent notes that some 300 prints may be required before any adjustment of the ink metering elements reaches the paper and equilibrium is reliably established in the ink transport mechanism. That patent also describes a method for achieving a desired ink profile, which method assumes that the inking unit has been washed and cleaned prior to setting up the desired profile. However, as noted above, such cleaning and washing of the inking mechanism between successive printing jobs is not in accord with present day practice. Rather, most printing press operators would merely run off successive waste sheets during the transition period between the previous and the successive print jobs.

In contrast, the present invention provides a method of transition between a previous and a subsequent desired ink profile without the necessity of cleaning and washing the inking unit or of removing excess ink therefrom by the printing of an excessive number of waste sheets.

Figure 2:
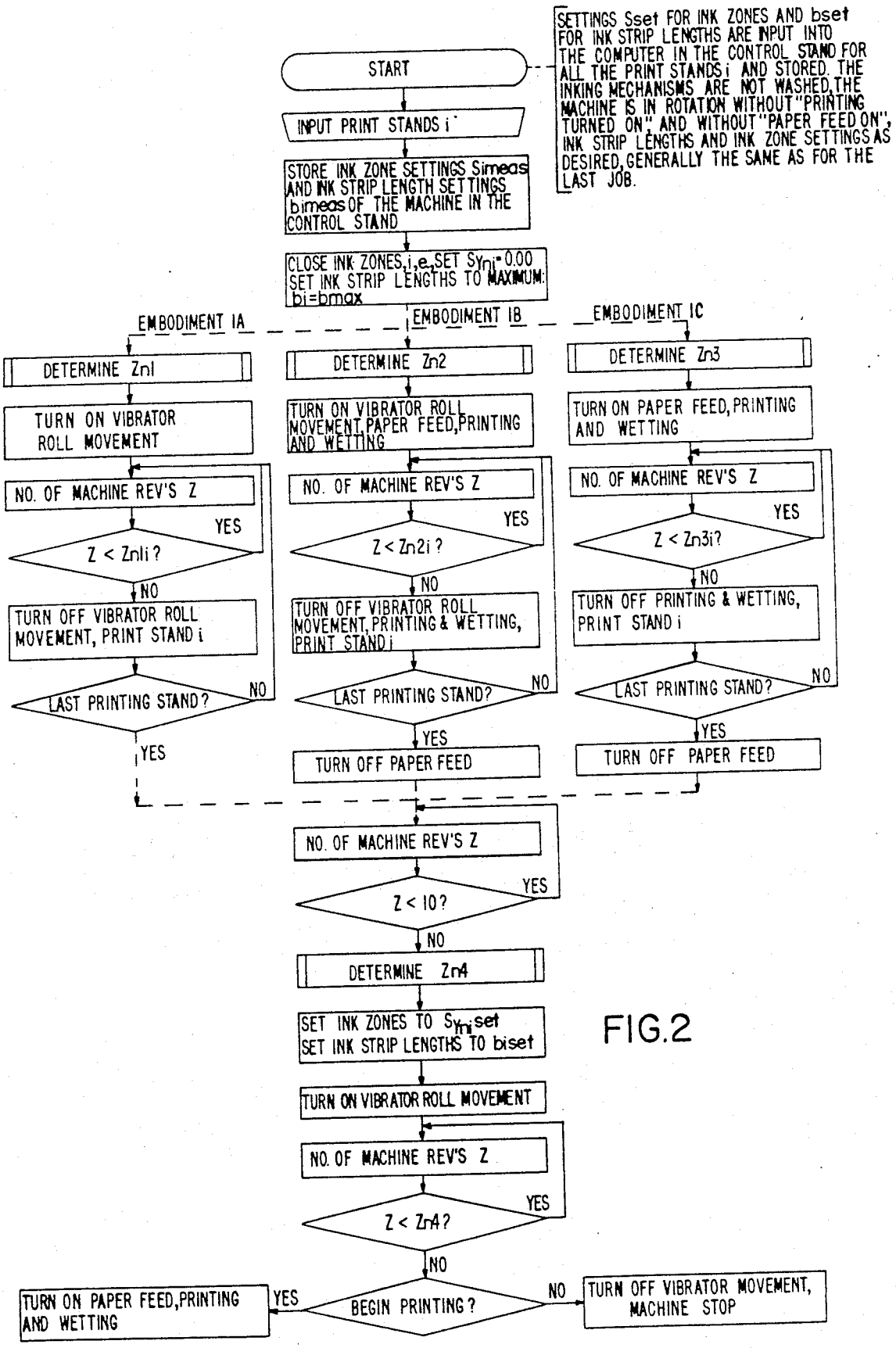
FIG. 2 is a flow chart of a process according to a first embodiment of the present invention for adjusting the inking mechanism of a rotary offset printing press, such as that depicted in FIG. 1.
Figure 3:
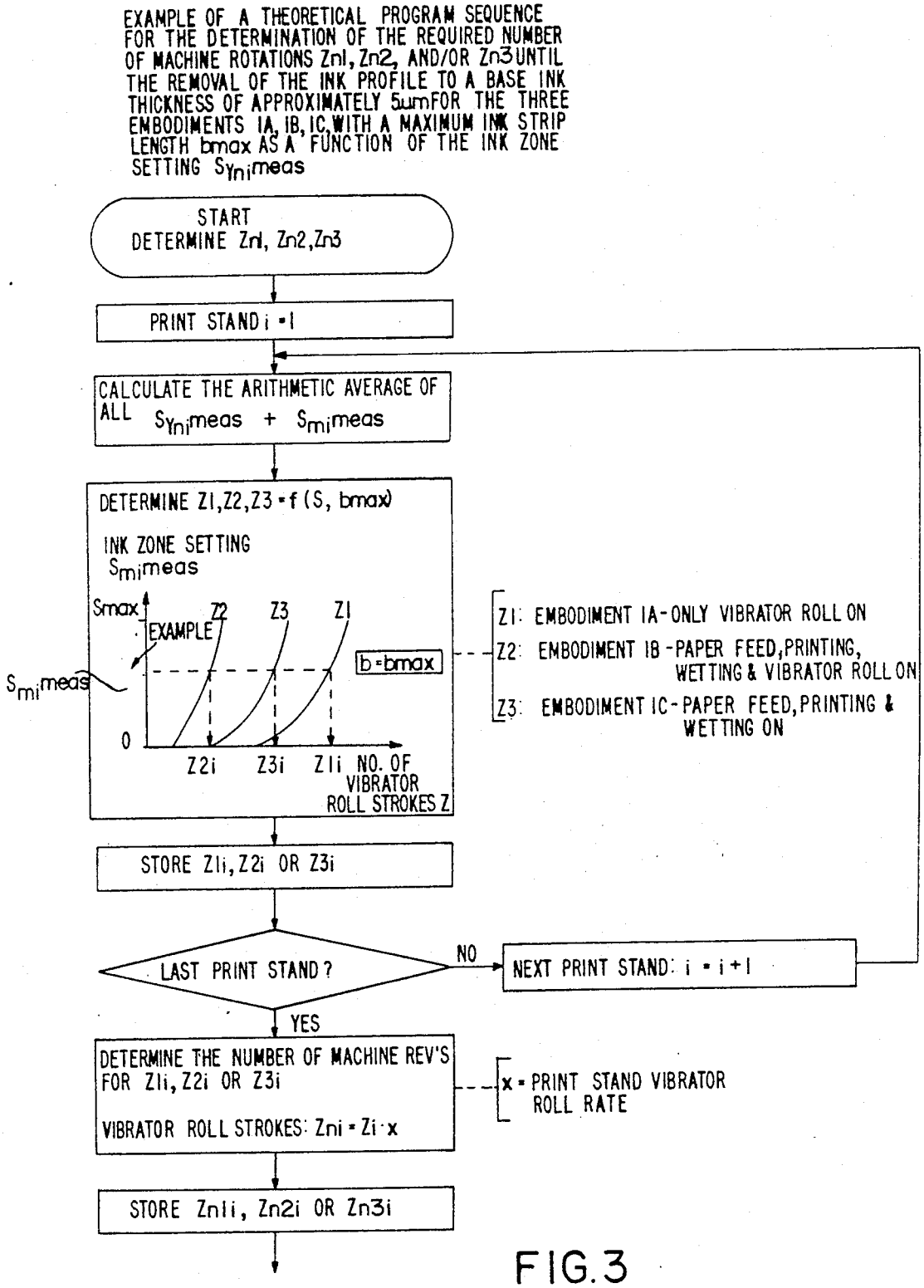
FIG. 3 is a flow chart of a subprocess for determining certain parameters for the implementation of a process conducted according to FIG. 2.
Figure 4:
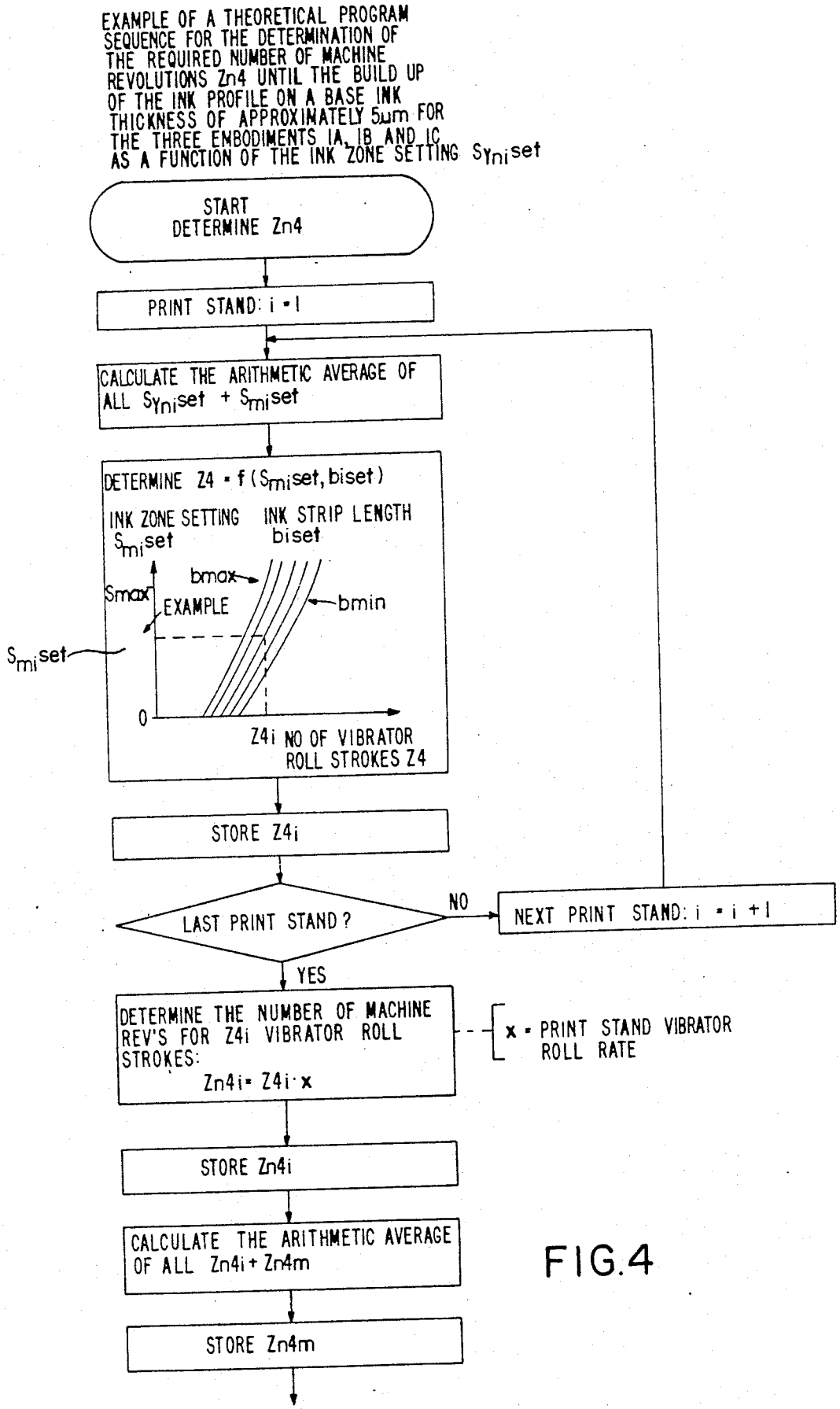
FIG. 4 is a flow chart of another subprocess for determining an additional parameter for the implementation of a process conducted according to FIG. 2.

In a first embodiment of the invention, the steps of which are schematically indicated in the flow charts of FIGS. 2, 3 and 4, ink is transferred from the inking mechanism back into the ink reservoir until a base ink layer of, for example, 5 microns is established in the inking mechanism. Thereafter, the desired subsequent ink profile may be established in a determined number of print stand revolutions through adjustment of the zonal ink zone settings and the ink strip lengths transferred by the vibrator roller.

In a second embodiment of the invention, the steps of which are schematically set forth in FIGS. 5, 6*a*, 6*b* and 6*c*, a direct transition is made between the preceding and subsequent ink profiles without the necessity of an intervening reduction to a base ink layer.

We turn now to FIG. 2, wherein a first embodiment of the invention is illustrated which presumes that the printing stand would be in a typical condition following the termination of a previous printing job. That is, the inking mechanism would not be cleaned and washed, but would carry the ink profile corresponding to the previous printing job. The printing stand would be in rotation, but the paper feed and printing processes would be temporarily suspended.

Typically, the ink zone settings Si and the ink strip lengths bi entered into (or measured from) the printing stand would be those appropriate for developing the ink profile required for the previous job, namely, Simeas and bimeas. The new (or subsequent) ink zone settings $S_{Yni}$set and ink strip lengths biset for the new or subsequent job are entered into the control stand computer. Methods by which the ink zone settings S and ink strip lengths b may be varied to thereby attain varying desired ink profiles are well known in the art and are described in documents incorporated by reference herein. Additionally, methods by which the ink zone settings S and ink strip lengths b which will achieve a desired ink application profile may be determined are also well known in the art and are described in documents incorporated by reference herein.

Each ink zone within the printing stand is now closed. That is, $S_{Yni}$ is set to zero. At the same time, the ink strip length bi within the printing stand is set to the maximum bmax.

With the ink zones closed, ink is transferred from the inking mechanism back into the ink reservoir provided in the printing stand. The ink strip lengths bi determine the quantity of ink transferred by the vibrator roller. With the ink strip lengths set to bmax, the maximum amount of ink is transferred back into the ink reservoir.

Hereafter, there are three submethods encompassed by the first embodiment of the present invention.

In Embodiment 1A, the vibrator roll is activated, and the paper feed, printing and wetting mechanisms are temporarily held in abeyance. That is, the primary method for removal of ink from the inking mechanism down to the desired base layer of, for example, 5 microns, is via the vibrator roll and back into the ink reservoir. The printing stand now performs a number of revolutions equal to Zn1i, the determination of which is described more fully below. Following Zn1i revolutions, a desired base ink layer of approximately 5 microns will have been substantially established.

In Embodiment 1B, ink is removed from the inking mechanism both via the vibrator roll transfer back to the ink reservoir and also through an actual printing process. Thus, the vibrator roller, as well as the paper feed, printing and wetting mechanisms are activated. Thereafter, the printing stand performs Zn2i revolutions, the determination of which number is explained more fully below, after which a desired base ink layer will have been substantially established.

In Embodiment 1C, the vibrator roller is not activated, and the removal of ink from the inking mechanism takes place primarily via the printing process. Thus, the paper feed, printing and wetting mechanisms are activated, and the printing stand executes Zn3i revolutions, the determination of which number is explained more fully below, after which a desired base ink layer will have been substantially established.

At this point, the three embodiments 1A, 1B and 1C converge, and the printing stand executes a predetermined number of stabilizing revolutions Z, for example, 10.

Thereafter, as discussed more fully below, the number of printing stand revolutions Zn4 required, with ink zone settings of $S_{Yni}$set and ink strip lengths biset, to establish the desired ink profile appropriate for the subsequent printing job is determined. The inking mechanism (including the vibrator roller) is now activated to transfer ink from the ink reservoir back into the inking mechanism, and the printing stand executes Zn4 rotations.

Finally, the printing of the subsequent job may be executed immediately or postponed.

FIG. 3 sets forth a subroutine for the determination of the number of printing stand revolutions Zn1, Zn2 and Zn3 required for the removal of ink down to a desired base layer according to the Embodiments 1A, 1B and 1C set forth in FIG. 2.

Initially, the arithmetic average of all ink zone settings $S_{mi}$meas of all ink zone settings $S_{Yni}$meas currently existing in the printing stand is calculated. Typically, the existing ink zone settings $S_{Yni}$meas will be those utilized for the establishment of the desired ink profile of the preceding job.

Thereafter, the desired number of vibrator roller strokes, either Z1i, Z2i or Z3i, is determined, according to which of the three embodiments 1A, 1B or 1C is to be employed in the practice of the invention. In all three cases, as noted in both FIGS. 2 and 3, the ink strip lengths b of each ink zone are set to the maximum bmax. The relationship between the average ink existing zone settings $S_{mi}$meas and the number of vibrator roller strokes Z required for establishment of the desired base layer may be established, as is well known in the art and described in documents incorporated herein, either empirically or by simulation for the particular printing stand being employed.

Finally, when the required number of vibrator roll strokes Z1i, Z2i or Z3i has been established for each print stand i, the corresponding number of printing stand revolutions may be determined via conversion by the printing stand vibrator roll rate x.

FIG. 4 sets forth schematically a method for the determination of the number of printing stand revolutions Zn4 required to construct a desired ink profile for a subsequent printing job on a predetermined base ink layer of, for example, 5 microns. For each printing stand i, the arithmetic average $S_{mi}$set of all ink zone settings for the new printing job $S_{Yni}$set is calculated. Using $S_{mi}$set, the number of required vibrator roller strokes Z4 is determined. As shown in FIG. 4, Z4 is also a function of the ink strip length biset. The relationship between $S_{mi}$set and Z4 or various ink strip length settings biset may be established either empirically or by simulation as is well known in the art and described in documents incorporated by reference herein.

The number of vibrator roller strokes Z4i for each printing stand i having thus been determined, the corresponding number of printing stand revolutions Zn4i is then determined by conversion, using the printing stand vibrator roller rate x.

Finally, the arithmetic average Zn4m of all printing stand revolutions Zn4i is determined, and this value is employed in the process according to the first embodiment of the invention described above primarily with reference to FIG. 2.

Figure 5:
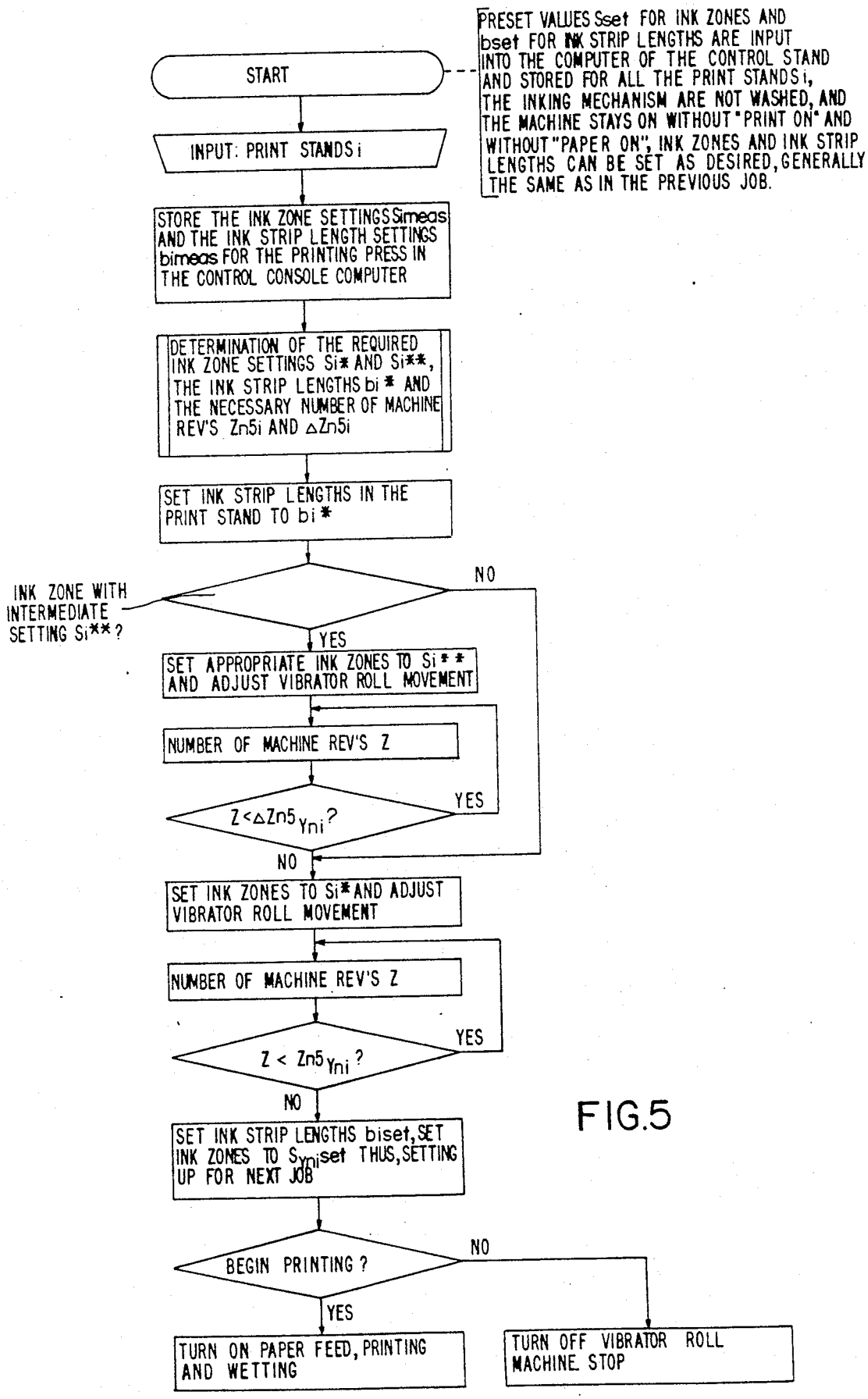
FIG. 5 is a flow chart of a process according to a second embodiment of the present invention for adjusting the inking mechanism of an offset rotary printing press, such as that depicted in FIG. 1.

FIG. 5 shows schematically an overall view of a process according to the second embodiment of the invention, wherein a transition is made directly from the preceding ink profile to the desired subsequent ink profile, without an intervening reduction to a base ink layer. Generally, the process begins with the printing stand configured as it would be at the end of the previous printing job. That is, the inking mechanism has not been cleaned and washed, and the ink zone settings and ink strip lengths stored in the printing stand will typically be those required for the establishment of the ink profile of the previous printing job.

Initially, the existing ink zone settings Simeas and the existing ink strip lengths bimeas are either entered into the control computer, or they may already reside therein due to the execution of the previous printing job.

Thereafter, as explained below with reference to FIGS. 6a, 6b and 6c, the following parameters are determined and/or calculated:

Si* = the required ink zone settings for either the addition of ink to, or the removal of ink from, each ink zone during a number of vibrator roller strokes Zn5i;

bi* = the ink strip lengths which, in conjunction with the ink zone settings Si*, will either remove from, or transfer to, an appropriate volume of ink for each ink zone during a number of vibrator roller strokes Zn5i;

Si = an equilibrium ink zone setting at which ink will be neither transferred to nor removed from the inking mechanism: and ΔZn5i = the number of vibrator roller strokes during which a particular ink zone should be set to the equilibrium setting Si, such that ink is neither transferred to nor removed from that ink zone.

As noted immediately above, there are two separate ink zone settings Si* and Si**, as well as two separate respective numbers of vibrator roller strokes Zn5i and ΔZn5i, employed using a process carried out according to the second embodiment of the present invention. The present inventor has determined that, in general, ink can be fed much more rapidly into the inking mechanism than it can be removed therefrom. That is, for a given quantity of ink, many fewer vibrator roller strokes (and, therefore, many printing stand revolutions) are required to transport the ink from the inking reservoir into the inking mechanism than are required to withdraw the same quantity from the inking mechanism and back into the ink reservoir. In general, and for the average ink thicknesses encountered, the ratio is approximately 1:10, assuming the desired ink profile is being built up on a base ink layer of approximately 5 microns, or assuming that the existing profile is being reduced to a similar base ink layer.

If, according to the second embodiment of the invention, a direct transition is being made between the existing and subsequent ink profiles, then generally, the ink zone in which the maximum amount of ink is to be transported out of the inking mechanism and back into the ink reservoir is the ink zone which will determine the total number of printing stand revolutions required to execute the process. If, on the other hand, in those ink zones in which ink is to be transported from the ink reservoir and into the inking mechanism, the ink zone settings were to be maintained at Si* throughout the entire Zn5i printing stand revolutions, then an excess of ink in these ink zones would result. Accordingly, for a determined number of printing stand revolutions ΔZn5i, the ink zones in which a substantial amount of ink is to be transported into the inking mechanism are set to an equilibrium ink zone setting Si**, such that, during the initial ΔZn5 printing stand revolutions, ink is neither transported into or out of the inking mechanism. Thereafter, from ΔZn5i to Zn5i printing stand revolutions, ink is transported into the inking mechanism at an ink zone setting of Si*.

The value ΔZn5i may be calculated as described more fully below in connection with FIG. 6b, or it may be chosen to be a certain percentage of the total number of printing stand revolutions Zn5i required for accomplishing a direct transition process. For example, ΔZn5i may be determined, assuming that 90 percent of the required printing stand revolutions Zn5i will have been executed prior to the addition of a positive volume difference $\Delta V_{Yni}$. The positive volume difference ΔV may then be determined for each ink zone requiring the addition of ink. Then, during the remaining 10 percent of the required printing stand revolutions Zn5i, each required addition ΔV may be introduced into the inking mechanism at ink zone settings Si* determined as discussed below.

Further, the present invention contemplates that, in those ink zones wherein ink is being transferred out of the inking mechanism and back into the ink reservoir, it may be appropriate to initially transfer an excess amount of ink back into the reservoir and, thereafter, to transfer this excess amount of ink back into the inking mechanism. This variation is a result of the "ink splitting laws" which are clearly described in U.S. Pat. No. 4,660,470. As noted therein, during transport of the ink through the numerous rollers of the inking mechanism, an ink gradient is set up. For example, during transfer from the ink reservoir to the plate cylinder, in each ink zone, the greatest ink thickness exists on the roller closest to the ink reservoir, and this ink thickness decreases on successive rollers as the ink approaches the printing plate.

Conversely, if in a particular ink zone, ink is being transferred back to the ink reservoir, a reverse gradient is eventually established, in which the inking roller closest to the printing plate carries the greatest thickness of ink, with the ink thickness on successive rollers being gradually reduced in the direction of the ink reservoir.

Since one object of the present invention is the establishment of a desired ink profile and an associated appropriate ink gradient, in order that printing may begin as soon as possible, it may therefore be desirable to initially withdraw an additional amount of ink and to thereafter restore the additional ink withdrawn, thereby establishing an appropriate ink addition gradient decreasing the direction of the printing plate, such as would be employed during the subsequent printing process.

Referring back now to FIG. 5, following determination of the parameters Si*, Si**, bi*, Zn5i and ΔZn5i, the ink strip lengths in the printing stand are set to bi*, and a determination is made as to whether any of the ink zones in the printing stand should be set to an intermediate (or equilibrium) setting Si**. If so, the appropriate ink zones are so set, and the printing stand is caused to begin executing successive revolutions.

Following each successive revolution, for each ink zone Yni of the printing stand set to the intermediate (or equilibrium) setting Si**, a determination is made as to whether the number of printing stand revolutions so far executed is equal to the number of intermediate (or equilibrium) revolutions $\Delta Zn5_{Yni}$ for that particular ink zone. When such determination yields a positive result, each ink zone Yni is then set to an appropriate ink zone setting Si*, so as to yield a rapid construction of the desired ink profile for the subsequent job.

When each ink zone Yni has had either the appropriate amount of ink added thereto or removed therefrom, as indicated by the fact that the total number of printing stand rotations executed equals the number of revolutions $Zn5_{Yni}$ appropriate for that ink zone, the ink strip lengths biset and the ink zone settings $S_{Yni}$set which will maintain a substantially constant and appropriate flow of ink for the subsequent printing job may be entered into the printing stand.

Finally, printing of the subsequent job may begin immediately, or may be held in abeyance for some time.

Figure 6B:
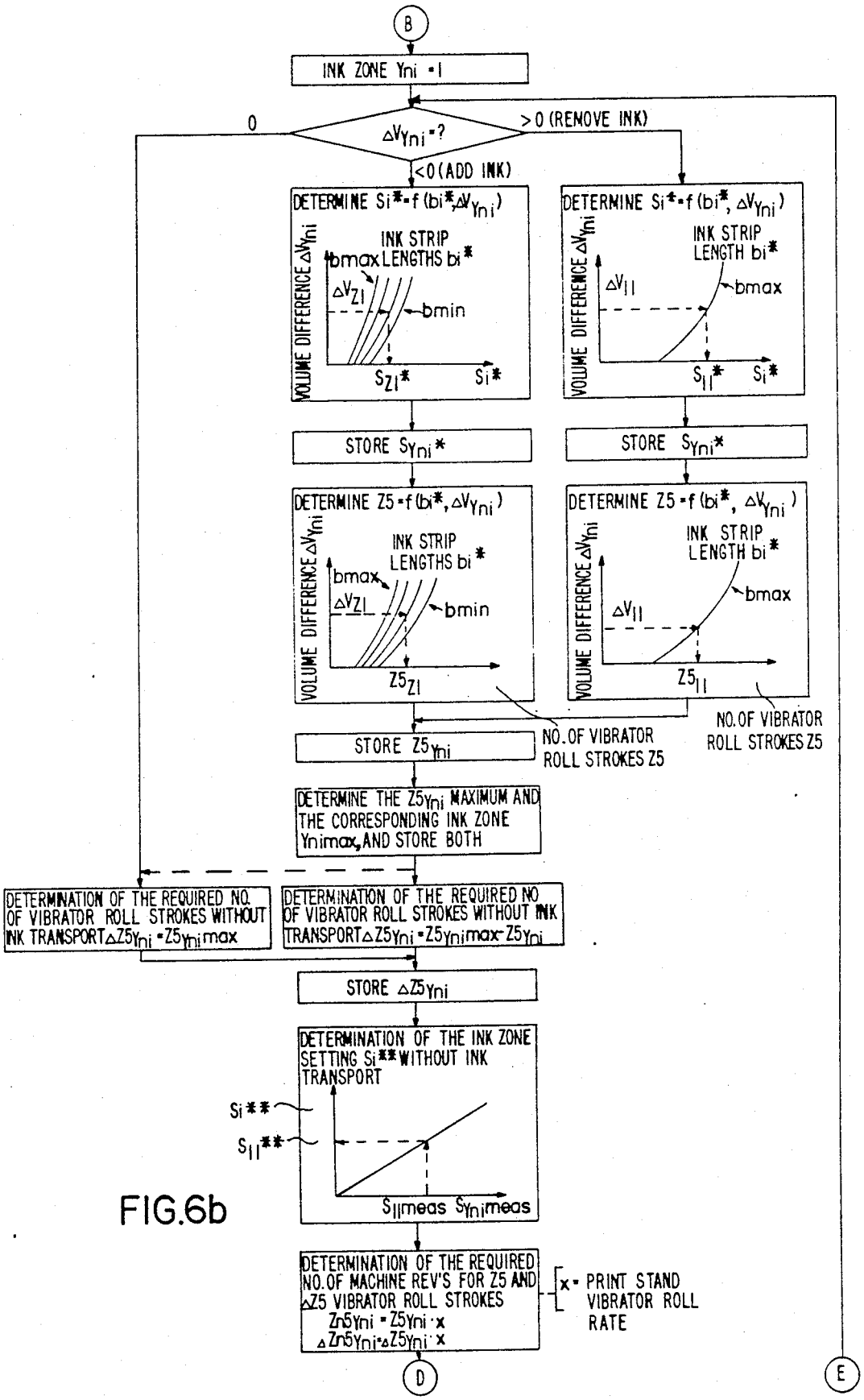
Figure 6C:
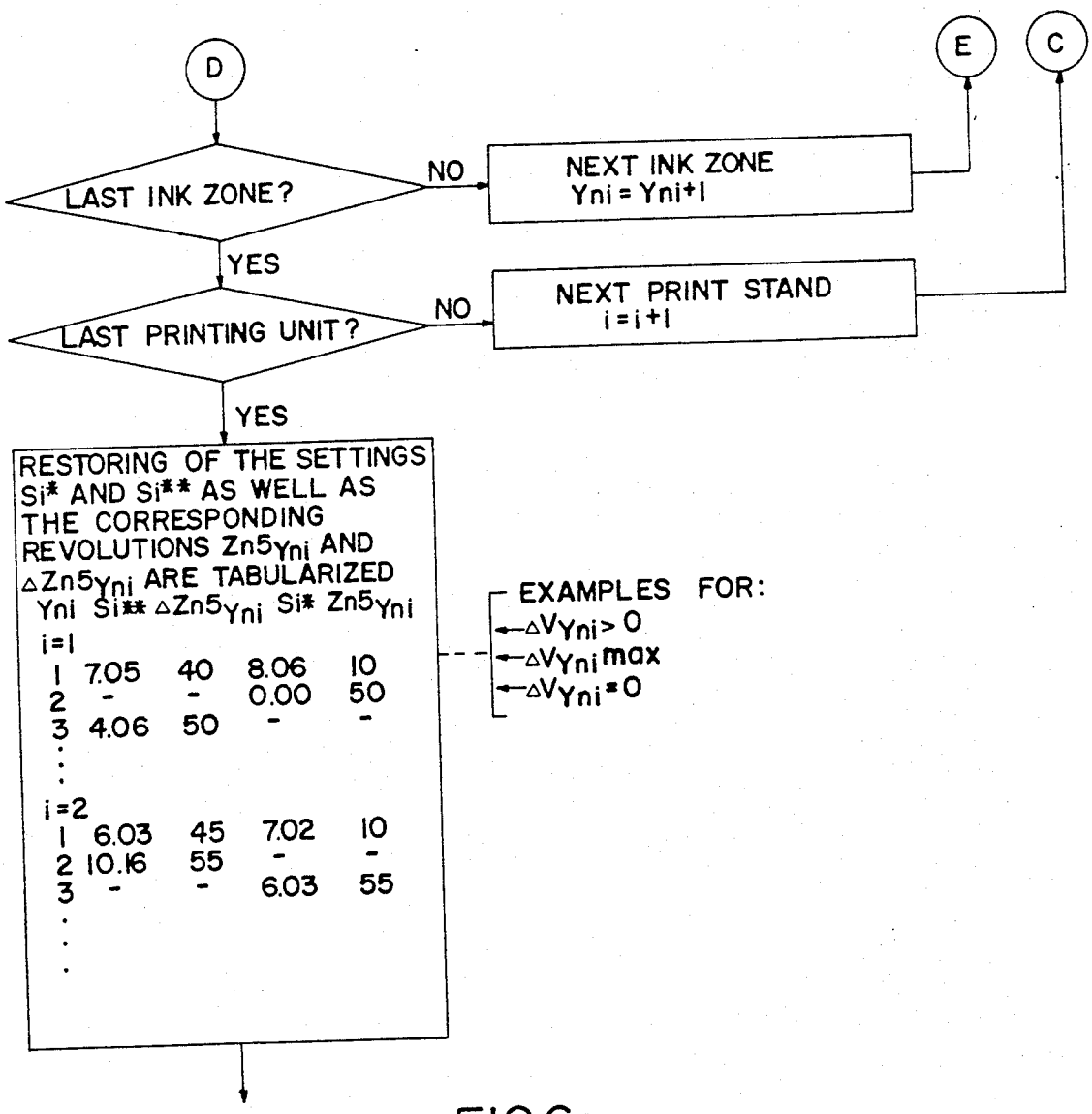

Referring now to FIGS. 6a, 6b and 6c, the determination of the parameters bi*, Si*, Si**, Zn5i and ΔZn5i is carried out as follows:

For each ink zone Yni in each printing stand i, a number ΔV, which is indicative of the difference in the volume of ink (or ink volume change) required between the previous and subsequent jobs, is calculated. For example, knowing the "ink splitting laws" as described in U.S. Pat. No. 4,660,470, the ink zone setting of the previous job $S_{Yni}$meas, the ink strip length of the previous job bi*meas and the circumferences of all rollers in the inking mechanism, a stored volume V could be calculated. Additionally, a base layer volume $V_G$ corresponding to the base layer thickness of approximately 5 microns on all rollers, could also be calculated. The difference between these two so-calculated volumes $V-V_G$ would yield a job-specific storage volume $V_A$. Two such job-specific storage volumes $V_{A1}$ and $V_{A2}$, corresponding to the previous job and the subsequent job, respectively, could also be determined. Their difference $\Delta V_A = V_{A1} - V_{A2}$ would theoretically yield the volume of ink which must be transferred either into or out of the inking mechanism in a direct transition from the previous to the subsequent ink profile.

However, given the specific characteristics of a particular printing stand, it is unnecessary to calculate the actual volume difference $\Delta V_A$. Rather, for each ink zone Yni in each printing stand i, a volume difference indicator $\Delta V_{Yni}$ is calculated, which is equal to the difference between the products of the ink zone settings $S_{Yni}$ and the ink strip lengths bi* of the previous and subsequent jobs. The volume difference indicator $\Delta V_{Yni}$ calculated is thus inherently indicative of the actual volume change $\Delta V_{AYni}$ required in each ink zone. A $\Delta V_{Yni}$ greater than zero indicates that ink must be removed from the inking mechanism for a particular ink zone, and a $\Delta V_{Yni}$ less than zero indicates that ink must be added. Similarly, a $\Delta V_{Yni}$ of zero indicates that no ink volume change is necessary for a particular ink zone.

All ink zone volume difference indicators $\Delta V_{Yni}$ are checked for greater than and less than zero conditions. If all ink zone volume difference indicators are substantially zero, then adjustment of the ink profile becomes unnecessary. If at least one of the ink zone volume difference indicators is greater than zero, indicating the required removal of ink from that ink zone, then the ink strip length is set to the maximum value bmax of the printing stand. If no ink zone volume difference indicators are greater than zero, but at least one is less than zero, indicating only the addition of ink in at least one ink zone, then the ink strip length is set to a value biset, derived as discussed below.

Referring now to FIG. 6b, for each ink zone Yni, appropriate parameters are determined depending upon whether there is to be an addition to, a reduction from or no change in the ink volume.

If there is to be an ink volume reduction, the appropriate transition ink zone setting Si* is determined using an empirically or simulatively derived relationship between the ink volume difference indicator $\Delta V_{Yni}$ and the ink zone setting Si*. To expedite the ink removal, the relationship used is that established for a maximum ink strip length bmax.

Thereafter, the required number of vibrator roller strokes Z5 is similarly determined as a function of the ink volume difference indicator, and using a maximum ink strip length of bmax.

If, on the other hand, ink is to be added to a particular ink zone Yni, the particular transition ink zone setting for that ink zone $S_{Yni}$* is determined using an empirically or simulatively derived relationship with the ink strip length set to the bi* value selected. Similarly, the required number of vibrator roller strokes Z5 is determined to yield an appropriate ink volume addition at ink strip length bi*.

Having now determined, for each ink zone, an appropriate transition ink zone setting Si* and the required number of printing stand revolutions to effect the desired ink volume change at that transition ink zone setting, the maximum number of printing stand revolutions $Z5_{Yni}$max and the corresponding ink zone Ynimax may also be determined. For each ink zone, a difference $\Delta Z5_{Yni}$ is now determined which corresponds to the number of initial revolutions during which an ink zone setting should be maintained at the intermediate (or equilibrium) setting Si**. As noted in FIG. 6*b*, if ink is neither to be added nor removed from a particular ink zone, that ink zone is maintained at the Si** setting throughout the entire $\Delta Z5_{Yni}=Z5_{Yni}$max vibrator roller strokes of the transition process.

Next, actual intermediate (or equilibrium) ink zone settings Si are calculated for each ink zone which will utilize an equilibrium ink zone setting Si during the transition process. As illustrated, the appropriate equilibrium ink zone setting may be determined as a function of the existing ink zone setting $S_{Yni}$meas, normally existing as a result of the previous printing job. Methods of establishing the proper relationship are well known in the art and are described in documents incorporated herein.

The thus determined required vibrator roller strokes $Zn5_{Yni}$ and $\Delta Z5_{Yni}$ are now translated into required printing stand revolutions through use of a conversion factor x=the printing stand vibrator roller rate.

The above process is repeated iteratively, as required, for each ink zone of each printing stand, and the determined parameters are tabulated and stored in the control stand computer, as noted in FIG. 6*c*.

The invention as described hereinabove in the context of the preferred embodiments is not to be taken as limited to all of the provided details thereof, since modifications and variations thereof may be made without departing from the spirit and scope of the invention.

What is claimed is:

1. A controlled process for producing a previous ink zone profile corresponding to a previous printing job in at least one printing stand of a printing press and for changing from the previous ink zone profile corresponding to the previous printing job to a subsequent ink zone profile corresponding to a subsequent printing job, said subsequent printing job being carried out immediately subsequent to said previous printing job, said printing stand comprising a printing plate cylinder for positioning a printing plate, an ink reservoir for holding a supply of ink and an inking mechanism for transferring the ink between said ink reservoir and said printing plate during operation of said printing stand, said inking mechanism comprising a plurality of inking rollers, a plurality of individually adjustable ink zone metering devices, at least one ink fountain roller positioned adjacent said plurality of individually adjustable ink zone metering devices, and at least one ink transfer roller for transferring the ink between said ink fountain roller and at least one of said plurality of inking rollers, each of said plurality of individually adjustable ink zone metering devices defining a substantially corresponding ink zone of said at least one printing stand, said process comprising the steps of:

(a) producing the previous ink zone profile by initiating operation of:
 said printing plate cylinder,
 said plurality of inking rollers,
 said at least one ink transfer roller, and
 said at least one ink fountain roller, and
by transferring ink from said ink reservoir to said printing plate cylinder via forward a route of travel which extends:
 from said ink reservoir through at least one of said plurality of individually adjustable ink zone metering devices,
 thereafter to said at least one ink fountain roller,
 thereafter to said at least one ink transfer roller,
 thereafter to said plurality of inking rollers, and
 thereafter to said printing plate cylinder;

(b) printing said previous printing job;

(c) terminating the printing of said previous printing job; and (d) changing to subsequent ink zone profile corresponding to said immediately subsequent printing job by the process comprising the steps of:

(e) calculating at least one previous parameter characterizing said previous ink zone profile;

(f) calculating at least one subsequent parameter characterizing said subsequent ink zone profile;

wherein said subsequent printing job is carried out immediately subsequent to said previous printing job; and (g) adjusting at least one of said plurality of adjustable ink zone metering devices, in accordance with said calculated previous and said subsequent parameters, and operating said inking mechanism to thereby change the ink zone profile in said printing stand from said previous ink zone profile to said subsequent ink zone profile, said operation of said inking mechanism comprising the transfer of ink from said inking mechanism and through at least one of said plurality of individually adjustable ink zone metering devices to said ink reservoir;

wherein said adjusting and operating step (g) comprises the steps of:

(g1) adjusting at least one of said plurality of individually adjustable ink zone metering devices to transfer ink from said inking mechanism to said ink reservoir;

(g2) initiating operation of:
 said printing plate cylinder,
 said plurality of inking rollers,
 said at least one ink transfer roller, and
 said at least one ink fountain roller;
to transfer ink from said printing plate cylinder to said ink reservoir via a reverse route of travel which extends:

from said printing plate cylinder to said same plurality of inking rollers as in step (a), thereafter to said same at least one ink transfer roller as in step (a), thereafter to said same at least one ink fountain roller as in step (a), thereafter through at least one of said same plurality of individually adjustable ink zone metering devices as in step (a), and thereafter to said same ink reservoir as in step (a);

(g3) continuing operation of said printing plate cylinder, said plurality of inking rollers, said at least one ink transfer roller and said at least one ink transfer roller until said plurality of inking rollers have a defined base ink layer deposited thereon;

(g4) adjusting at least one of said plurality of individually adjustable ink zone metering devices to transfer ink from said ink reservoir to said inking mechanism;

(g5) initiating operation of said at least one ink transfer roller to thereby transfer ink, on the surface of said at least one ink transfer roller, to said inking mechanism through at least one of said plurality of individually adjustable ink metering devices;

(g6) continuing operation of said at least one ink transfer roller until said subsequent ink zone profile is established; and (h) printing said immediately subsequent printing job.

2. The process according to claim 1, wherein said previous and subsequent parameters calculated in said steps (e) and (f) comprise, respectively, a value indicative of the volume of ink existing in said inking mechanism from said previous printing job, and a value indicative of the volume of ink required in said inking mechanism for execution of said subsequent printing job.

3. The process according to claim 1, wherein said plurality of ink zone metering devices adjustably transfer ink between said ink reservoir and said inking mechanism in accordance with individual ink zone setting, and wherein said previous parameter comprises a derived function of said individual ink zone settings used for said previous printing job.

4. The process according to claim 3, wherein said derived function comprises an arithmetic average of said previous individual ink zone settings.

5. The process according to claim 3, wherein, using said derived function of said previous ink zone settings, a required number of inking mechanism actuations for the removal of ink from said inking mechanism necessary to the realization of said base ink layer therein is determined, and wherein said steps (g2) and (g3) of operation of said inking mechanism are carried out for said determined required number of inking mechanism actuations.

6. The process according to claim 5, wherein said inking mechanism additionally comprises adjustable vibrator roller means for transferring ink strips between said ink reservoir and at least one of said plurality of inking rollers, the lengths of said transferred ink strips being adjustable, and wherein, during said steps (g2) and (g3) of achievement of said base ink layer, said vibrator roller means is adjusted so as to transfer an ink strip of maximum length from said at least one of said plurality of inking rollers to said ink reservoir.

7. The process according to claim 6, wherein, during said steps (g2) and (g3) of achievement of said base ink layer, said printing stand is additionally actuated to thereby remove ink from said inking mechanism through the carrying out of printing of ink on an ink receiving medium.

8. The process according to claim 5, wherein, during said steps (g2) and (g3) of achievement of said base ink layer, said printing stand is actuated to thereby remove ink from said inking mechanism through the carrying out of printing of ink on an ink receiving medium.

9. The process according to claim 5, wherein said inking mechanism additionally comprises adjustable vibrator roller means for transferring ink strips between said ink reservoir and said rollers, the lengths of said ink strips being adjustable, wherein, during said steps (g4), (g5) and (g6 ) of transferring ink from said ink reservoir to said inking mechanism, said ink metering devices and said ink strip lengths are adjusted to desired values to establish said subsequent ink profile, wherein, using said desired values of said ink zone settings and said ink strip lengths, a required number of inking mechanism actuations for establishment of said subsequent ink profile is determined, and wherein said step (g5) of transferring ink from said ink reservoir to said inking mechanism is carried out for said determined required number of inking mechanism actuations.

10. A controlled process for producing a previous ink zone profile corresponding to a previous printing job in at least one printing stand of a printing press and for changing from the previous ink zone profile corresponding to the previous printing job to a subsequent ink zone profile corresponding to a subsequent printing job, said subsequent printing job being carried out immediately subsequent to said previous printing job, said printing stand comprising a printing plate cylinder for positioning a printing plate, an ink reservoir for holding a supply of ink and an inking mechanism for transferring the ink between said ink reservoir and said printing plate during operation of said printing stand, said inking mechanism comprising a plurality of inking rollers, a plurality of individually adjustable ink zone metering devices, at least one ink fountain roller positioned adjacent said plurality of individually adjustable ink zone metering devices, and at least one ink transfer roller for transferring the ink between said ink fountain roller and at least one of said plurality of inking rollers, each of said plurality of individually adjustable ink zone metering devices defining a substantially corresponding ink zone of said at least one printing stand, said process comprising the steps of:

(a) producing the previous ink zone profile by initiating operation of:

said printing plate cylinder, said plurality of inking rollers, said at least one ink transfer roller, and said at least one ink fountain roller, and by transferring ink from said ink reservoir to said printing plate cylinder via a forward route of travel which extends:

from said ink reservoir through at least one of said plurality of individually adjustable ink zone metering devices, thereafter to said at least one ink fountain roller, thereafter to said at least one ink transfer roller, thereafter to said plurality of inking rollers, and thereafter to said printing plate cylinder;

(b) printing said previous printing job;

(c) terminating the printing of said previous printing job; and (d) changing to subsequent ink zone profile corresponding to said immediately subsequent printing job by the process comprising the steps of:

(e) calculating at least one previous parameter characterizing said previous ink zone profile;

(f) calculating at least one subsequent parameter characterizing said subsequent ink zone profile;

wherein said subsequent printing job is carried out immediately subsequent to said previous printing job; and (g) adjusting at least one of said plurality of adjustable ink zone metering devices, in accordance with said calculated previous and said subsequent parameters, and operating said at least one ink transfer roller to transfer ink, on the surface of said at least one ink transfer roller, to thereby change the ink zone profile in said printing stand from said previous ink zone profile to said subsequent ink zone profile, said operation of said at least one ink transfer roller comprising the transfer of ink from said printing plate cylinder to said ink reservoir, in at least one of said ink zones in said at least one printing stand, via a reverse route of travel which extends from:

said printing plate cylinder to said same plurality of inking rollers as in step (a), thereafter to said same at least one ink transfer roller as in step (a), thereafter to said same at least one ink fountain roller as in step (a), thereafter through at least one of said same plurality of individually adjustable ink zone metering devices as in step (a), and thereafter to said same ink reservoir as in step (a);

said at least one previous parameter characterizing said previous ink zone profile calculated in said step (e) comprising a previous volumetric indicator indicative of the volume of said previous ink zone profile remaining in said inking mechanism in each of said plurality of ink zones as a result of said previous printing job; and said at least one subsequent parameter characterizing said subsequent ink zone profile calculated in said step (f) comprising a subsequent volumetric indicator indicative of said subsequent ink zone profile required in said inking mechanism in each of said plurality of ink zones for said subsequent printing job; and wherein said adjusting step (g) comprises the additional steps of:

(g1) calculating, for each of said plurality of ink zones, a volumetric difference indicator indicative of the change of ink volume in said inking mechanism between the ink volume remaining from said previous printing job and the ink volume required for said subsequent printing job;

(g2) adjusting and operating each of said plurality of ink metering devices in accordance with the corresponding ink zone volumetric difference indicator calculated in step (g1);

(g3) continuing operation of said printing plate cylinder, said plurality of inking rollers, said at least one ink transfer roller and said at least one ink transfer roller until establishment of said subsequent ink zone profile in said inking mechanism is substantially achieved; and (h) printing said immediately subsequent printing job.

11. The process according to claim 10, wherein said step (g2) of adjusting said plurality of ink metering devices comprises the additional steps of:

(g2A) calculating, for each of said ink zones and using the corresponding ink zone volumetric difference indicator, a number of inking mechanism actuations required to substantially produce said corresponding ink zone volumetric difference in said inking mechanism; and (g2B) determining the maximum number of inking mechanism actuations calculated in said step (g2A);

wherein the continuing operation of said inking mechanism performed in said step (g3) is terminated when the number of inking mechanism actuations executed substantially equals the maximum number of inking mechanism actuations determined in said step (g2B).

12. The process according to claim 11, wherein said inking mechanism additionally comprises adjustable vibrator roller means for transferring ink strips between said ink reservoir and at least one of said plurality of inking rollers, the lengths of said ink strips being adjustable, and wherein said process comprises the additional steps of:

determining whether any of said ink zone volumetric difference indicators calculated in step (g2A) indicates a removal of ink from an ink zone corresponding thereto in order to accomplish said change in ink volume in said inking mechanism; and if said removal of ink from said corresponding ink zone is so indicated by said corresponding ink zone volumetric difference indicator, adjusting said vibrator roller means so as to transfer an ink strip of maximum length from said at least one of said plurality of inking rollers to said ink reservoir.

13. The process according to claim 11, wherein said inking mechanism additionally comprises adjustable vibrator roller means for transferring ink strips between said ink reservoir and at least one of said plurality of inking rollers, the lengths of said ink strips being adjustable, and wherein said process comprises the additional steps of:

determining whether the following Conditions exists: Condition:

(1) none of said ink zone volumetric difference indicators calculated in said step (g2A) indicates a removal of ink from an ink zone corresponding thereto in order to accomplish said change in ink volume in said inking mechanism; and (2) at least one of said ink zone volumetric difference indicators calculated in said step (g2A) indicates an addition of ink from an ink zone corresponding thereto in order to accomplish said change in ink volume in said inking mechanism; and;

if said Condition does exist, adjusting said vibrator roller means so as to transfer, from said ink reservoir to said at least one of said plurality of inking rollers, said corresponding volumetric ink zone difference at least within said maximum number of inking mechanism actuations determined in said step (g2B).

14. The process according to claim 13, wherein said process comprises the additional steps of:

(i) determining, for each of said plurality of ink zones, a corresponding difference between said required number of inking mechanism actuations calculated in said step (g2A) and said maximum number of inking mechanism. actuations determined in said step (g2B);

(j) determining which, if any, of said corresponding differences determined for each of said plurality of ink zones in said step (i) are nonzero;

(k) for substantially all nonzero corresponding differences determined for each of said plurality of ink zones in step (j), determining a corresponding equilibrium ink zone setting for said corresponding ink zone metering device which will establish an equilibrium condition wherein the considerable transport of ink between said ink reservoir and said inking mechanism is substantially prevented; and (i) during execution of said maximum number of inking mechanism actuations determined in said step (g2B) and executed in said step (g3), setting each of said corresponding ink zone metering devices to said corresponding determined equilibrium ink zone settings for a number of inking mechanism actuations substantially equal to said corresponding differences.

15. The process according to claim 14, wherein said equilibrium ink zone settings are determined empirically as a function of said previous volumetric indicator.

16. The process according to claim 14, wherein said equilibrium ink zone settings are determined by simulation as a function of said previous volumetric indicator.

17. The process according to claim 13, wherein said process comprises the additional steps of:

(i) determining, for each of said plurality of ink zones, a corresponding difference between said required number of inking mechanism actuations calculated in said step (g2A) and said maximum number of inking mechanism actuations determined in step (g2B);

(j) determining which, if any, of said corresponding differences determined for each of said plurality of ink zones in said step (i) are nonzero;

(k) for substantially all nonzero corresponding differences determined for each of said plurality of ink zones in step (j), determining a corresponding equilibrium ink zone setting for said corresponding ink zone metering device which will establish an equilibrium condition wherein the considerable transport of ink between said ink reservoir and said inking mechanism is substantially prevented; and (i) during execution of said maximum number of inking mechanism actuations determined in said step (g2B) and executed in said step (g3), setting each of said corresponding ink zone metering devices to said corresponding determined equilibrium ink zone settings for a number of inking mechanism actuations substantially equal to said corresponding differences.

18. The process according to claim 17, wherein said equilibrium ink zone settings are determined empirically as a function of said previous volumetric indicator.

19. The process according to claim 17, wherein said equilibrium ink zone settings are determined by simulation as a function of said previous volumetric indicator.

* * * * *

UNITED STATES PATENT AND TRADEMARK OFFICE

CERTIFICATE OF CORRECTION

PATENT NO. : 5,010,820

DATED : April 30, 1991

INVENTOR(S) : Gerhard LOFFLER

It is certified that error appears in the above-identified patent and that said Letters Patent is hereby corrected as shown below:

In column 1, line 51, after 'patent', insert --is--.

Col. 15, In Claim 3, line 4, after 'zone', delete "setting," and insert --settings,--.

Col. 18, In Claim 13, line 8, after 'following', delete "Conditions" and insert --Condition--.

Col. 18, In Claim 14, line 1, after 'claim', delete "13" and insert --12--.

Signed and Sealed this

Twelfth Day of January, 1993

*Attest:*

*Attesting Officer*

DOUGLAS B. COMER

*Acting Commissioner of Patents and Trademarks*